US010835451B2

(12) United States Patent
Van Goolen et al.

(10) Patent No.: US 10,835,451 B2
(45) Date of Patent: Nov. 17, 2020

(54) APPARATUS AND PROCESS FOR FILLING PARTICULATE MATERIALS

(71) Applicant: Capsugel Belgium NV, Bornem (BE)

(72) Inventors: Gunther Van Goolen, Hombeek (BE); Stefaan Jaak Vanquickenborne, Rijmenam (BE)

(73) Assignee: Capsugel Belgium NV (BE)

( * ) Notice: Subject to any disclaimer, the term of this patent is extended or adjusted under 35 U.S.C. 154(b) by 255 days.

(21) Appl. No.: 15/503,646

(22) PCT Filed: Aug. 4, 2015

(86) PCT No.: PCT/EP2015/067897

§ 371 (c)(1),
(2) Date: Feb. 13, 2017

(87) PCT Pub. No.: WO2016/023788

PCT Pub. Date: Feb. 18, 2016

(65) Prior Publication Data

US 2017/0258685 A1 Sep. 14, 2017

(30) Foreign Application Priority Data

Aug. 14, 2014 (EP) ..... 14181014

(51) Int. Cl.
*A61J 3/07* (2006.01)
*B65B 1/38* (2006.01)
(Continued)

(52) U.S. Cl.
CPC ..... *A61J 3/074* (2013.01); *B65B 1/04* (2013.01); *B65B 1/385* (2013.01); *B65B 3/14* (2013.01);
(Continued)

(58) Field of Classification Search
CPC . A61J 3/074; B65B 1/04; B65B 1/385; B65B 3/14; B65B 3/30; B65B 7/28; B65B 2210/10
(Continued)

(56) References Cited

U.S. PATENT DOCUMENTS 2,362,791 A * 11/1944 Ayars ..... B65B 3/22 141/70
2,932,330 A * 4/1960 Donofrio ..... B65B 3/32 141/178
(Continued)

FOREIGN PATENT DOCUMENTS

EP 0912396 1/2011

OTHER PUBLICATIONS

YouTube video titled "Tales from the Prep Room: Making Sand Swim" published by The Royal Institution on May 11, 2012; link: https://www.youtube.com/watch?v=zjgURBIqJ6s (Year: 2012).*
(Continued)

*Primary Examiner* — Chelsea E Stinson
*Assistant Examiner* — Himchan Song
(74) *Attorney, Agent, or Firm* — Klarquist Sparkman, LLP

(57) ABSTRACT

An apparatus for dosing solid particulate material into one or more receptacles, the apparatus comprising: a reservoir for containing an amount of solid particulate material; a dosing unit comprising a dose collection position for collecting a predetermined dose of solid particulate material from the reservoir, and a dose release position for releasing the solid particulate material into the one or more receptacles; a receptacle handling unit for retaining the one or more receptacles, arranged to at least periodically align at least one of the one or more receptacles with the dosing unit when in the dose release position; and optionally a receptacle
(Continued)

closing unit for closing the one or more receptacles once filled with the solid particulate material; wherein the dosing unit comprises one or more dosing chambers arranged to displace relative to said reservoir, and/or vice versa, along a perpendicular axis Y such that at least a portion of the chamber(s) is capable of being immerged into, and emerged out of, the solid particulate material at least when the dosing unit is in the dose collection position, the reservoir being arranged to impart a fluid-like state to the solid particulate material at least for the duration of the displacement.

16 Claims, 7 Drawing Sheets

(51) Int. Cl.
*B65B 1/04* (2006.01)
*B65B 3/14* (2006.01)
*B65B 3/30* (2006.01)
*B65B 7/28* (2006.01)

(52) U.S. Cl.
CPC ..... *B65B 3/30* (2013.01); *B65B 7/28* (2013.01); *B65B 2210/10* (2013.01)

(58) Field of Classification Search
USPC ..... 53/281, 436, 527, 560
See application file for complete search history.

(56) References Cited

U.S. PATENT DOCUMENTS 3,656,518 A * 4/1972 Aronson ..... B65B 1/38 141/1
3,847,191 A * 11/1974 Aronson ..... B65B 63/028 141/12
3,893,492 A * 7/1975 Nohren ..... B65B 1/385 141/1
4,660,608 A * 4/1987 Arai ..... A45D 33/006 100/116
4,804,550 A * 2/1989 Bardsley ..... B65B 1/24 141/12
4,887,475 A * 12/1989 Austin ..... B65B 1/04 73/866
5,363,887 A * 11/1994 Haeberli ..... A45D 33/00 100/226
5,372,791 A * 12/1994 Abdulally ..... B01J 8/1818 422/139
5,626,171 A * 5/1997 Mirri ..... A61J 3/074 141/145
5,826,633 A * 10/1998 Parks ..... B65B 1/366 141/18
6,182,712 B1 * 2/2001 Stout ..... A61J 3/02 141/125
6,425,422 B1 * 7/2002 Trebbi ..... A61J 3/074 141/67
6,499,831 B2 * 12/2002 Schmidlin ..... B65G 54/02 347/55
6,722,801 B2 * 4/2004 Snape ..... G06K 15/102 400/61
6,772,801 B1 * 8/2004 Shojaei ..... A61K 9/5089 141/11
6,786,579 B2 * 9/2004 Noolandi ..... B05B 7/1404 347/21
6,805,175 B1 * 10/2004 Pinkas ..... B65B 1/16 141/130
6,886,612 B2 * 5/2005 Duffield ..... A61J 3/00 141/284
7,051,771 B2 * 5/2006 Ede ..... B65B 63/02 141/71
7,210,507 B2 * 5/2007 Facchini ..... A61J 3/074 141/144
7,284,679 B2 * 10/2007 Zill ..... B65B 1/16 222/1
7,614,429 B2 * 11/2009 Pluvinage ..... B01L 3/021 141/375
7,640,953 B2 * 1/2010 Ansaloni ..... A61J 3/074 141/147
7,677,016 B2 * 3/2010 Trebbi ..... B65B 1/48 53/560
7,836,922 B2 * 11/2010 Poole ..... G01G 13/24 141/72
2006/0174966 A1 * 8/2006 Facchini ..... B65B 37/02 141/67

OTHER PUBLICATIONS

International Preliminary Report on Patentability for PCT/EP2015/067897 (dated Feb. 23, 2017).
International Search Report for PCT/EP2015/067897 (dated Oct. 22, 2015).
Written Opinion for PCT/EP2015/067897 (dated Oct. 22, 2015).

* cited by examiner

APPARATUS AND PROCESS FOR FILLING PARTICULATE MATERIALS

CROSS REFERENCE TO RELATED APPLICATIONS

This is the U.S. National Stage of International Application No. PCT/EP2015/067897, filed Aug. 4, 2015, which in turn claims the benefit of and priority to European Patent Application No. 14181014.3, filed Aug. 14, 2014.

FIELD

The present disclosure relates to apparatuses and processes for filling of solid particulate material(s) into one or more receptacles. The receptacles may be in the form of dosage form articles, preferably multi-part capsules or two-part hard capsules, typically suitable for the delivery of one or more drugs via oral, or other, administration of the same to a subject. More particularly, the dosage form articles are suitable for ingestion by a subject, preferably the subject being selected from humans or animals.

In particular, the present disclosure can be advantageously applied to the filling and production of hard capsules which contain a medicament in solid form, such as pellets, microtablets, lipid-multiparticulates, and the like, especially lipid-multiparticulates.

BACKGROUND

Receptacle technology, and in particular capsule technology, continues to be subject to development and improvements and so does the filling thereof, including processes and equipment. In its basic form, standard containers for pharmaceuticals or other powdered, granular or liquid substances (generally referred to as telescope-type or two-piece capsules) include a tubular-shaped and/or cylindrically-shaped first part, namely a cap part, which is closed on one end and open on the other opposite end. A tightly fitting second part of similar shape, namely the body part, is of smaller diameter than the cap part and is typically telescopically engaged therein to form the overall dosage form or two-piece capsule. Similar capsule technology may be used to generate multi-compartment capsules.

The filling of such receptacles is generally carried out by filling machines common in the industry.

Modern receptacle filling machines for making, in particular, filled hard capsules, such as in U.S. Pat. No. 6,425,422, normally comprise a rotary turret or carousel equipped with a plurality of operating stations for processing the capsules according to a standard method consisting of the following sequence of basic steps: opening the closed empty capsules at a station where the capsule bodies are separated from the caps to form two separate rows of bodies and caps; filling a predetermined quantity of material in solid form into each capsule body at a dosing station; and closing each filled capsule by applying a cap to the respective body.

The dispensing of metered amounts of material is achieved by compressing the powder material, typically by application of a vacuum in a trough, followed by insertion of a filling gun within the compacted material to gather an amount of the compacted material followed in turn by dispensing such amount in a respective capsule, for example as described in U.S. Pat. No. 3,847,191.

Such machines still typically suffer from dose variation in the receptacles, particularly when filling a wide range of solid products having a wide range of packing densities and/or physical characteristics making handling difficult, such as shear sensitive materials. Such may cause a number of receptacles being generated having quite different amounts of fill and/or machine clogging, thus providing an undesirable variation in the population of receptacles being produced, as well as complex and repeated cleaning and maintenance of the machine. Such being particularly undesirable when the receptacles contain sensitive pharmaceutical products that must be administered at a predetermined concentration and dose.

As an attempt to solve some of the above problems, innovation in such machines has focused on measurement of the amount of fill in the receptacles by weighing methods post filling to reject any receptacles that do not meet a given pre-set parameter. Later developments have further improved such systems by volumetric measurements made before or during the filling step, for example U.S. Pat. No. 7,677,016, to further improve accuracy and reliability.

Such systems, still fail to address the root problem of dose variation that may occur during the actual filling step and particularly the accurate and consistent filling of shear sensitive materials into receptacles, as well as failing to address the problem of machine clogging and damage of certain particulate products (e.g. pellets).

Therefore there still remains a need for a new apparatus and process for accurate and consistent filling of receptacles with a wide range of solid fill materials, and in particular, shear sensitive materials.

SUMMARY

A first aspect of the present disclosure relates to an apparatus for dosing solid particulate material into one or more receptacles, the apparatus comprising: a reservoir for containing an amount of solid particulate material; a dosing unit comprising a dose collection position for collecting a predetermined dose of solid particulate material from the reservoir, and a dose release position for releasing the solid particulate material into the one or more receptacles; a receptacle handling unit for retaining the one or more receptacles, arranged to at least periodically align at least one of the one or more receptacles with the dosing unit when in the dose release position; and optionally a receptacle closing unit for closing the one or more receptacles once filled with the solid particulate material; wherein the dosing unit comprises one or more dosing chambers arranged to displace relative to said reservoir, and/or vice versa, along a perpendicular axis Y such that at least a portion of the chamber(s) is capable of being immerged into, and emerged out of, the solid particulate material at least when the dosing unit is in the dose collection position, the reservoir being arranged to impart a fluid-like state to the solid particulate material at least for the duration of the displacement.

A further aspect of the present disclosure relates to process of filling receptacles with the same.

A further aspect of the present disclosure relates to the use of an apparatus for the filling of receptacles.

DETAILED DESCRIPTION

Figure 1:
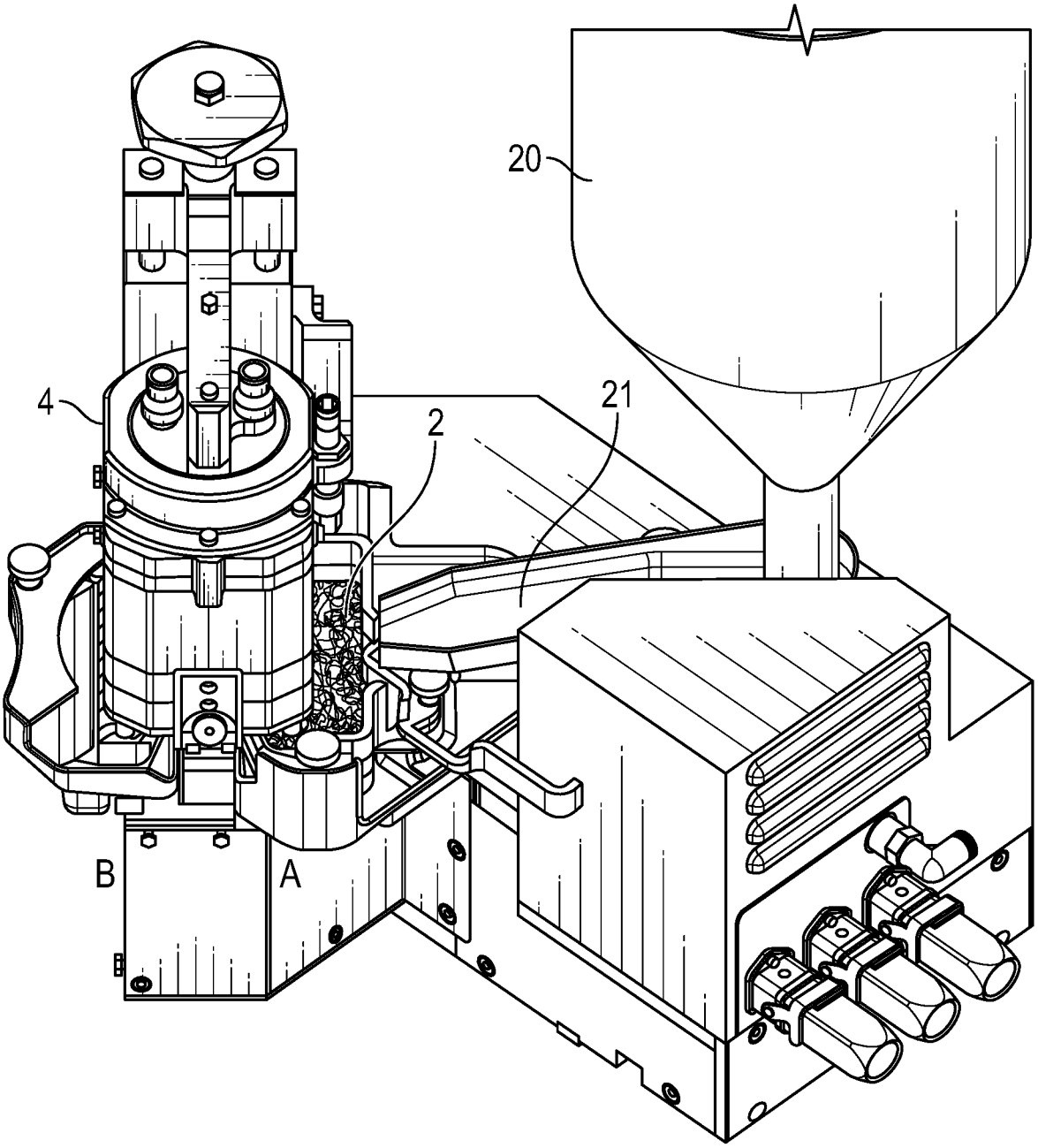
FIG. 1 illustrates an isometric view of an embodiment of the apparatus described herein.
Figure 2:
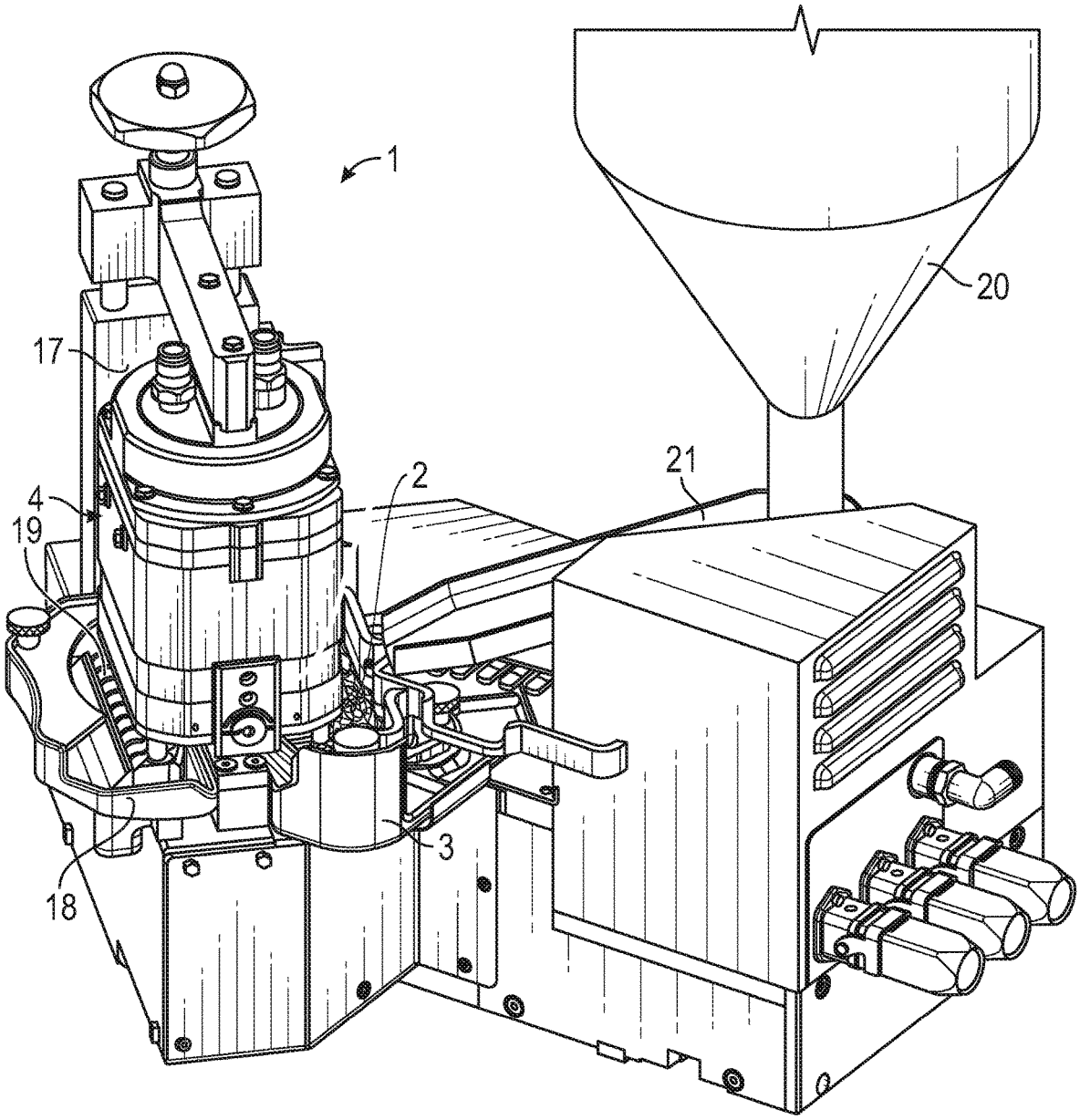
FIG. 2 illustrates an isometric view of an embodiment of the apparatus described herein.
Figure 3:
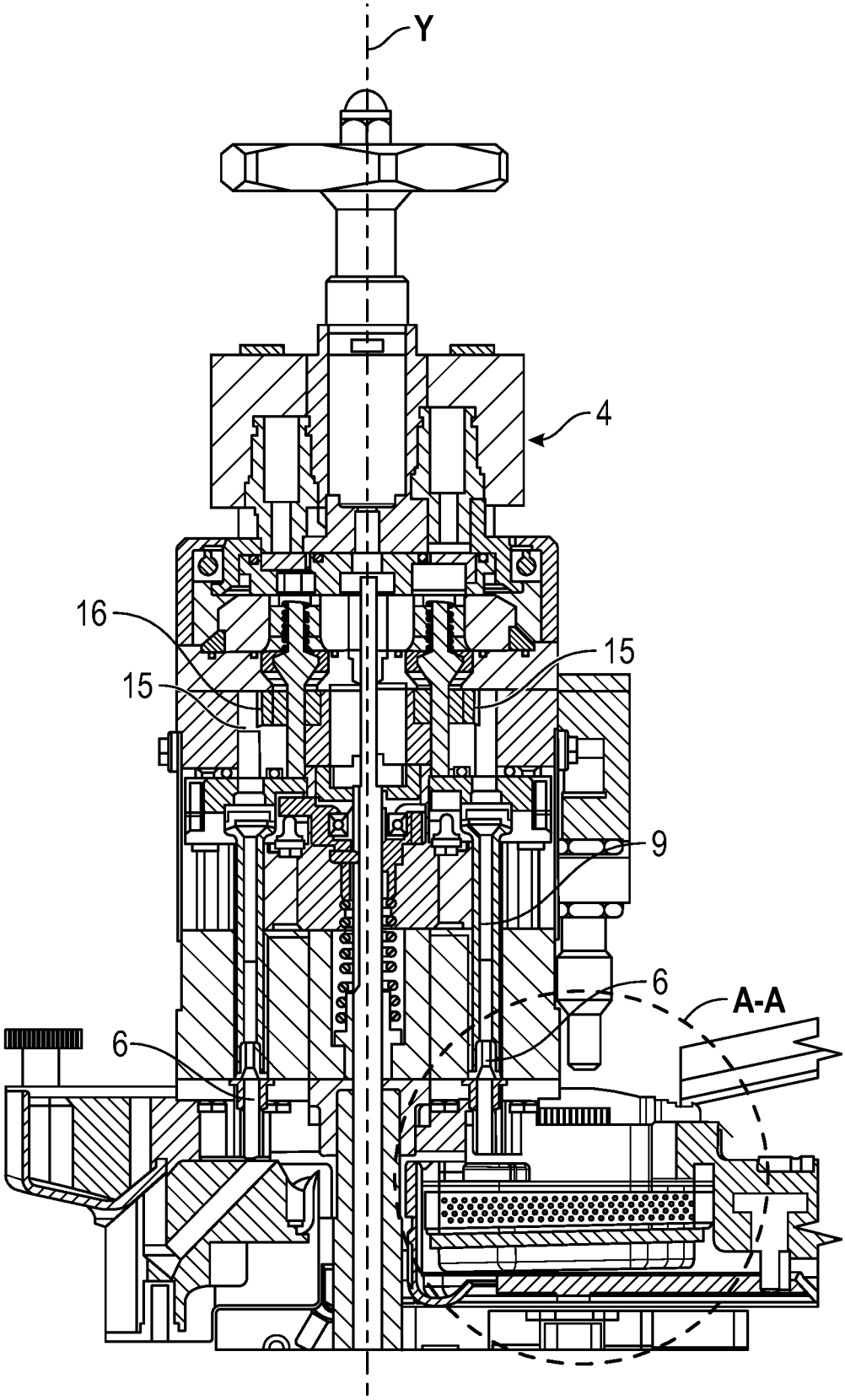
FIG. 3 illustrates a section view of the front of the dosing unit according to an embodiment of the apparatus described herein.
Figure 4:
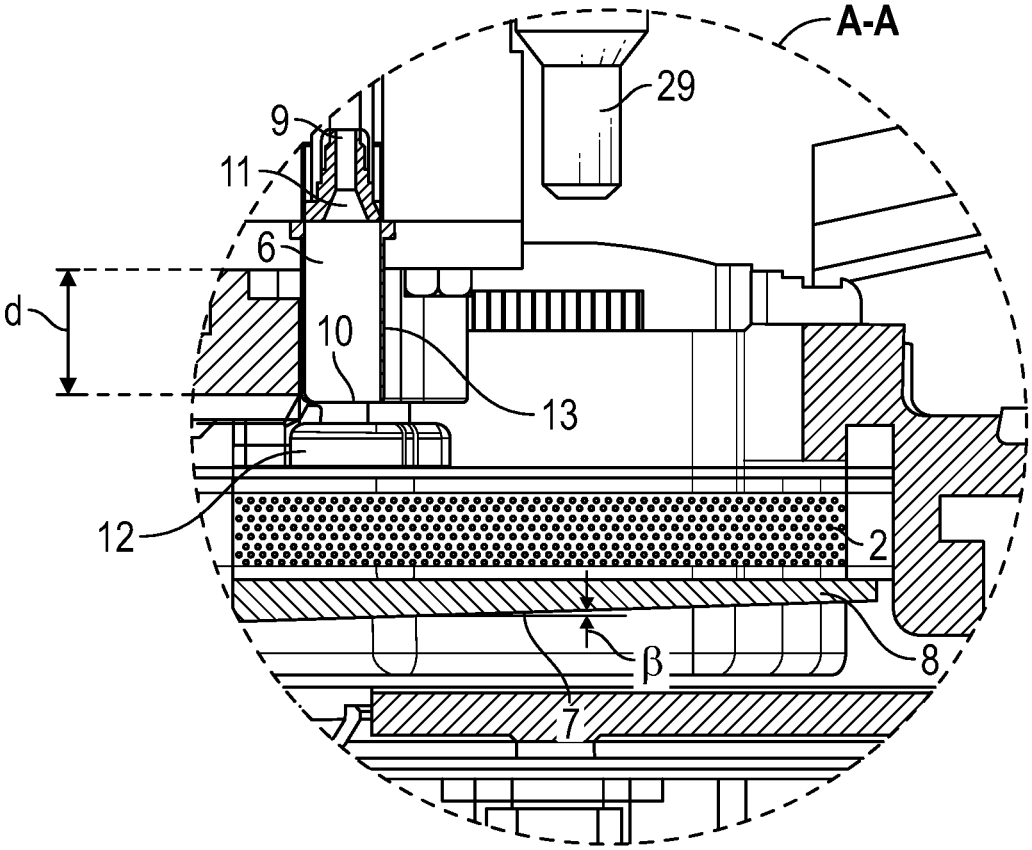
FIG. 4 illustrates an enlargement of area A-A in FIG. 3.
Figure 5A:
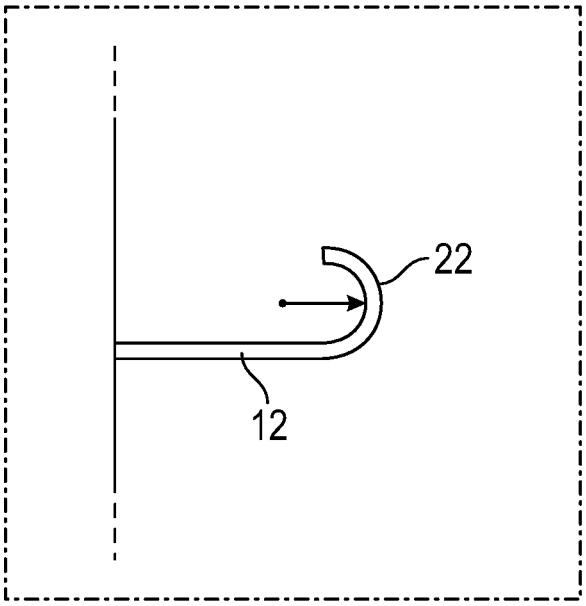
FIG. 5 (A & B) is a sketch illustrating the shape of the scrapers according to an embodiment of the apparatus described herein.
Figure 5B:
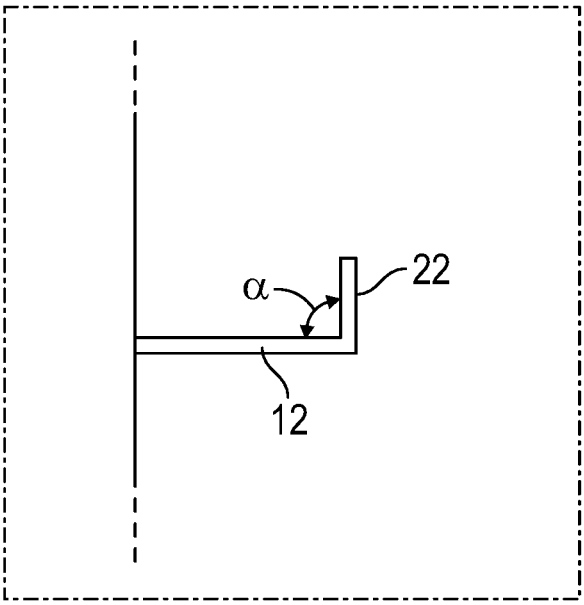
Figure 6:
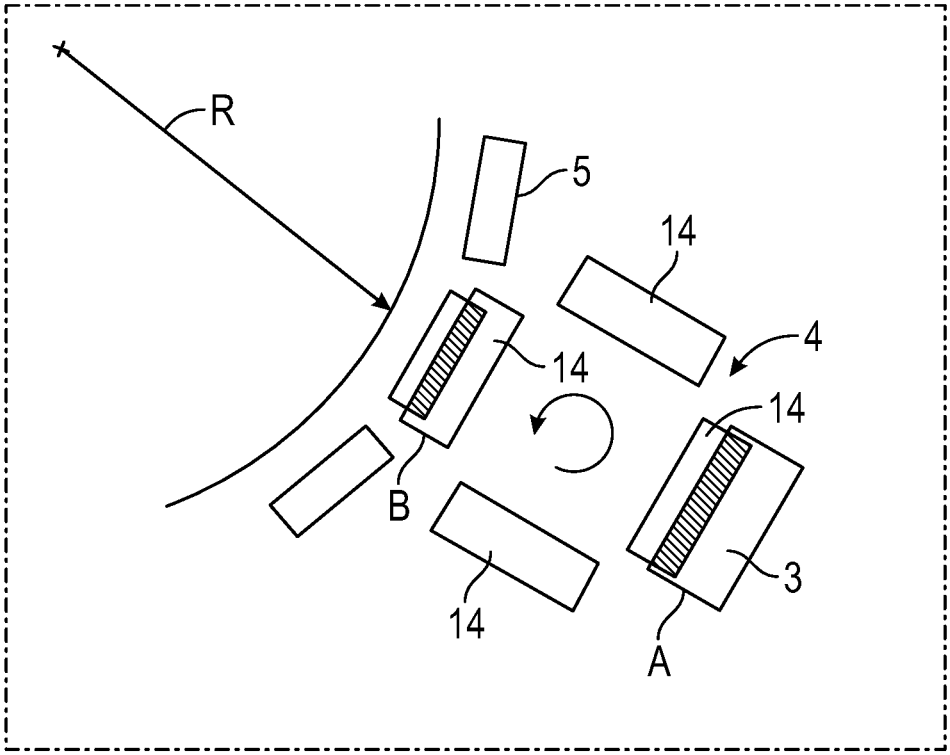
FIG. 6 is a diagrammatic representation illustrating the operating positions according to an embodiment of the apparatus described herein.

By the term "a" and/or "an" when describing a particular element, it is intended "at least one" of that particular element.

By the term "medicament", it is intended a "drug" or the like comprising one or more compounds providing one or more curative benefits to a subject, the terms "medicament" and "drug" may be used interchangeably herein.

By the term "hard shell" or "hard capsule shell", it is intended a shell that is deformable, but which substantially returns to its un-deformed shape upon the removal of a deforming force. Typically such shells comprise less than 25%, preferably less than 20%, more preferably from 0% to 14%, even more preferably from greater than 0% to less than 14%, water by weight.

By the term "fluid-like state", it is intended that the particles referred to are non-compacted or non-agglomerated/non-sedimented but rather are maintained in a fluidized state typically by action of a gas such as air that keeps the particles in dynamic motion such that the solid particles behave like a fluid (i.e. a liquid or gas).

By the term "shear-sensitive", it is intended a material that undergoes a structure change upon the application of a shear force, particularly shear forces subjected to the material concerned during the dosing stroke in common filling machines, such resulting in the smearing of one or more surfaces, typically such shear force (i.e. the force at which said structure change occurs) applied to the material is less than 0.08N, preferably from greater than ON to 0.05N, more preferably from 0.02N to 0.05N.

By the term "multi-particulate", it is intended a dosage form comprising a multiplicity of substantially individual particles, typically each being substantially spherical in shape, whose totality represents the intended therapeutically useful dose of a drug in question. The particles generally have of a mean diameter of from about 40 to about 3000 μm, preferably from about 50 to about 1000 μm, and most preferably from about 100 to about 300 μm.

By the term "pellet", it is intended an agglomeration of multi-particulates into larger particles, typically of varying shape (from substantially spherical or ovoidal to parallel-epipedal), generally having a mean particle size (or mean diameter) of from about 300 μm to 5000 μm, preferably from about 500 μm to about 3000 μm, more preferably from about 700 μm to about 2500 μm, even more preferably from about 800 μm to about 2000 μm, most preferably from about 900 μm to about 1500 μm.

By the term "lipid-multi-particulate", it is intended a multi-particulate comprising one or more lipids (generally as a lipid matrix) and typically tending to smear and agglomerate with the application of shear. The lipid-multi-particulate herein may have a melting temperature, Tm, of typically from 15° C. to 75° C., preferably from 15° C. to 45° C., more preferably from 15° C. to less than 45° C., and typically glass transition temperature, Tg, of typically from 10° C. to 65° C., preferably from 15° C. to 40° C., more preferably from 15° C. to less than 40° C. The ratio of Tm/Tg is typically greater than 1, preferably from greater than 1 to 2, more preferably from greater than 1 to less than 2, most preferably from greater than 1 to 1.5.

Various embodiments will now be described to provide an overall understanding of the principles of the structure, function, manufacture, and use of dosage form articles and methods disclosed herein. One or more examples of these embodiments are illustrated in the accompanying figures. Those of ordinary skill in the art will immediately understand that features described or illustrated in connection with one example embodiment can be combined with the features of other example embodiments without generalization from the present disclosure.

The Apparatus

Figure 8:
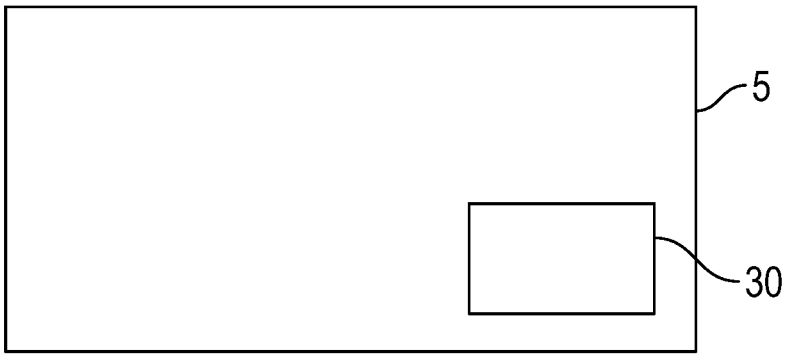
FIG. 8 schematically shows a receptacle retained by a receptacle handling unit.

In its basic form (as shown in FIG. 1 to FIG. 6), the apparatus of the present disclosure comprises: a reservoir 3 for containing an amount of solid particulate material 2, typically consisting of a multi-particulate as described herein; a dosing unit 4 comprising a dose collection position A for collecting a predetermined dose of said solid particulate material 2 from said reservoir 3, and a dose release position B for releasing said solid particulate material 2 into said one or more receptacles (not shown), preferably oral dosage form articles, more preferably two-piece hard capsules; a receptacle handling unit 5 for retaining said one or more receptacles 30 (as shown in FIG. 8), arranged to at least periodically align, preferably following a continuous motion of the same, at least one of the one or more receptacles with said dosing unit 4 when in said dose release position B; and optionally a receptacle closing unit (not shown) for closing said one or more receptacles once filled with said solid particulate material 2. The dosing unit 4 comprising one or more dosing chambers 6 arranged to displace relative to said reservoir 3, and/or vice versa, along a perpendicular axis Y such that at least a portion of said chamber(s) 6 is capable of being immerged into, and emerged out of, said solid particulate material 2 at least when said dosing unit 4 is in said dose collection position A. The reservoir being arranged to impart a fluid-like state to said solid particulate material 2 at least for the duration of said displacement and preferably continuously running during operation of the apparatus, typically such that the solid particulate material 2 is in a non-compressed (or non-compacted) state during the displacement of the camber(s) 6 into and out of the solid particulate material 2. An advantage of such arrangement is that local shear stresses are reduced during the displacement motion in the chamber(s)/solid particulate material interface, thus preventing phase transitions and/or smearing of shear sensitive materials which may result in clogging of the apparatus and/or dose variation. A further advantage is that pellets may be accurately dosed without the risk of crushing and damaging their shape as would happen during dosing by compaction, such enabling certain bioavailability benefits to be maintained with materials designed and manufactured to have a certain particle shape and size. A further advantage is that determination of the dose may be substantially less impacted by variability in packing density of the material to be dosed and immersion depth of the chamber(s).

The reservoir 3 may comprise a fluidized bed, wherein a fluid is injected from a bottom surface 7 of the reservoir 3 up, to provide sufficient turbulence to keep the solid particulate material 2 in a free-flowing and non-agglomerated state, preferably wherein said fluid is a gas. The bottom surface 7 may be slanted (i.e. at an angle β from a plane perpendicular to axis Y), preferably said surface 7 slanting downwards towards a region proximal to the chamber(s) 6. Such has been found to further improve and maximize fluidization of the particles in the region proximal to the chamber(s) during the dose collection displacement of the chamber(s) into the particles in the reservoir. The bottom surface 7 of the reservoir 3 may comprise a fluid distributor 8 arranged to uniformly distribute the fluid over substantially the entire bottom surface, preferably the fluid distributor 8 comprising or consisting of a porous membrane. Such arrangement has the advantage of ensuring that the entire content of the reservoir is kept in a fluid-like state.

During the immersion, emersion and positions following therefrom up to the dose release position, of the chamber(s) 6, a given dose of said material 2 is typically retained in the dosing chamber(s) 6 by a vacuum-like force generated by an under-pressure source in fluid communication with said dosing chamber(s) 6, said vacuum-like force generally being greater or equal to a gravitational force acting onto said dose of said solid particulate material 2. An advantage of such arrangement is that an amount of material may be sucked and retained substantially independently to the immersion depth of the chamber(s) during the immersion step.

The dosing unit may comprise a pusher 9 for each one or more dosing chambers 6, the pusher arranged to slide within said dosing chamber(s) 6 along a plane substantially parallel to the axis Y; typically wherein the pusher depth d may be adjusted depending on the desired target dose of solid particulate material 2 to be delivered to the one or more receptacles. In embodiments where a plurality of dosing chambers 6 are present, the depth d of the plurality of pushers 9 is simultaneously adjustable typically by a depth adjustment member (not shown) coupled to each said pusher 9. The depth adjustment member may be arranged to simultaneously displace the pushers even when the apparatus is in operation. The depth adjustment of the pushers may be automated or manual, preferably automated by coupling the depth adjustment member with a drive and preferably a dosing scale. A predetermined dose of material is thereby generated by the volume of the chamber(s) determined by the fixed cross-sectional surface area thereof (in a plane perpendicular to axis Y) and the adjusted pusher depth d.

The pusher depth d may be directly proportional to said desired target dose; preferably the pusher 9 is capable of pushing the solid particulate material out of said camber(s) 6 during at least a portion of a sliding motion, typically a downwardly motion or stroke in a direction towards an orifice 10 of said chamber(s) 6 generally when the dosing unit 4 is in the dose release position. Such sliding motion may be substantially simultaneous to a cut in the under-pressure source stopping the suction force (i.e. vacuum-like force). This has the advantage of reliably and gently releasing the dose into the receptacle without compacting said material.

The pusher 9 may have a tube-like form comprising at one end thereof a particle stopper 11, typically in the form of a mesh, sized such to prevent passage of the solid particulate material through said pusher but allowing a fluid, typically gas, to flow therethrough. The pusher 9 may be arranged to be in fluid communication with the chamber(s) 6 such that a gas may flow through said pusher 9 into said chamber, and/or vice versa, and typically wherein the pusher 9 is in fluid communication with an under pressure source.

In an embodiment, the apparatus comprises a calibration system (not shown) that may comprise a processing unit, typically comprising a controller, a sensing unit, typically comprising one or more position sensors proximal to one or more pushers or the adjustment member, and a weighing unit. The calibration system may be arranged such to determine the depth d of the pusher for providing a predetermined amount of dose. The calibration system may be arranged with a feedback loop such to automatically adjust the depth of the pusher based on the desired target dose. Preferably the processing unit is arranged to calculate the bulk density of the multi-particulate being dosed typically by processing signals received from the sensing unit (providing the position of the pusher to give distance d and thus the volume measured) and the weighing unit (providing the weight, typically in grams, of the amount of multi-particulate that fits within such volume) and calculate the new distance d required to provide a target dose. An advantage of such system is that accurate dosing may be achieved without compressing/compacting the multi-particulate and thus such accuracy may be expanded to a wider range of materials both powdery and non-powdery nature. Without wishing to be bound by theory it is believed that a consistent and accurate dose may be delivered by effective bulk density measurements as described above enabled by leveraging the very consistent packing behavior of fluidized multi-particulates in a given volume.

In an embodiment, the reservoir 3 or the dosing unit 4 comprises one or more, preferably a plurality of, dosing chamber levelers (also referred to herein as scrapers) 12 arranged to remove any solid particulate material resting on an outer surface 13, and/or proximal to an orifice 10, of said dosing chamber 6 once the dosing chambers have emerged out of said solid particulate material. Each chamber 6 may have at least one designated dosing chamber leveler 12 such that at least during the motion of said dosing unit from said dose collection position to said dose release position preferably just after the chamber 6 is emerged from the material and is still located over said reservoir, the chamber 6 is scraped by the respective dosing chamber leveler 12. This may bring advantages such as improved accuracy of the dose by more thorough elimination of material residue that may arise due to the vacuum-like force sucking the material into the chamber, as well as reduced contamination of apparatus parts.

The scraper(s) 12 may be cantilevered from a portion of the reservoir 3 and/or dosing unit 4 and/or support 17 and may have a protruding surface 22 proximal to an apex thereof to form a shape selected from semi-circular, semi-elliptical, rectilinear, and combinations thereof. When the protruding surface 22 is semi-circular, semi-elliptical or combinations, the effective radius r may be from 3 to 12 mm, preferably from 6 to 10 mm. When the protruding surface 22 is rectilinear the effective angle α may be from 20° to 90°, preferably from 40° to 60°. In case of combination of semi-circular/semi-elliptical and rectilinear, the effective radius r may be from 4 to 11 mm, and the effective angle α may be from 25° to 80°. Such arrangement improves efficacy of excess material elimination and thus contributes to further low fill variation.

In an embodiment, at least a portion of the dosing unit is arranged to rotate about an axis parallel to the perpendicular axis Y, or translate along an axis perpendicular to axis Y, from the dose collection position A to the dose release position B, preferably said rotation is substantially continuous. Such motion is typically from the dose collection position to the dose release position, either in a back and forth motion or in a continuous clockwise or anti-clockwise rotation about axis Y. Typically, said portion of the dosing unit is comprised of one or more moveable cassettes 14, preferably a plurality of cassettes 14, arranged to alternatingly move between the dose collection position A and the dose release position B.

In an embodiment, each dosing chamber 6 in the dosing unit comprises a chamber un-contaminating blower 15 arranged to trigger a first blow of fluid, typically a gas such as air, through the dosing chamber to remove any residue of solid particulate material from the dosing chamber 6, wherein said blower 15 is arranged to trigger said blow after the dose of solid particulate material has been delivered to the one or more receptacles typically once the pusher is retracted to at least its starting position having the advantage of maximizing pipe fluid dynamics and improving cleaning of the contaminated chamber(s), preferably wherein each chamber un-contaminating blower 15 shares the same blowing source typically in the form of a gas pump. An advantage of such arrangement is to further reduce risks of clogging and increase lifespan of the parts prior to cleaning and/or replacing.

In an embodiment, each dosing chamber 6 in the dosing unit comprises a dose release blower 16 arranged to trigger a second blow of fluid, typically a gas, through the dosing chamber to release a predetermined dose of solid particulate material from the dosing chamber, typically said dose release blower 16 is arranged to trigger said blow of fluid substantially simultaneously to a cut in an under-pressure source retaining said solid particulate material within the dosing chamber 6 against gravity and/or sliding of the pusher 9, typically the blow force generated by the dose release blower 16 is less than the blowing force generated by the chamber un-contaminating blower 15. In an embodiment, the dose release blower 16 and the chamber un-contaminating blower may be the same component arranged to release two different gas pressures. Preferably the trigger is timed to be when the dosing unit is in the dose release position.

In an embodiment, the apparatus herein comprises a dose verification means (not shown) to determine whether the filled receptacles are filled to the desired amount, and if not to provide a signal to a rejection means (not shown) to reject said receptacle. Similarly the apparatus herein may comprise means for detecting whether a reservoir is missing from the receptacle handling unit and arranged such to, if a receptacle is missing, prevent the dosing unit from releasing a dose in the respective location when in the dose release position.

In an embodiment, at least a portion of the dosing unit 4 is, typically rotatably, coupled to a support 17; the support 17 further comprising a dose converger 18 arranged between the receptacle retaining unit (also referred to herein as receptacle handling unit) 5 and the one or more dosing chambers 6 along the perpendicular axis Y; said converger 18, said receptacle retaining unit 4 and said dosing chamber(s) 6 being aligned with each other along said axis Y, preferably only, when said dosing unit 4 is in the dose release position B; preferably the dose converger 18 comprises one or more substantially funnel-shaped conduits 19 wherein each said conduit 19 is arranged to align with each said dosing chamber(s) 6 and each of the receptacles in the receptacle retaining unit 5 along said axis Y, preferably only, when said dosing unit 4 is in the dose release position B such that the solid particulate material is allowed to flow or drop from said dosing chamber(s) 6 through said conduit(s) 19 and into said receptacles to fill said receptacles. This arrangement has the advantage that risk of material being released out of the receptacle (i.e. missed by the receptacle) is reduced, as well as enabling the receptacles to be positioned at a distance from the centerline of the chambers (parallel to the axis Y) in a direction perpendicular to said axis Y (such is particularly increased by increasing the inclination of one of the surfaces of the funnel-shaped conduits at a greater angle compared to the remaining surfaces thereof), enabling the use of such units in a carousel type arrangement.

In an embodiment, the apparatus comprises a hopper 20 coupled to a reservoir filling unit 21 for filling the reservoir 3 with a constant amount of solid particulate material, preferably the filling unit 21 being coupled to a drive mechanism (not shown) to impart displacement thereof (preferably in an up/down motion along axis Y) such to provide flow of an amount of solid particulate material into said reservoir 3, this arrangement may minimize shear forces applied to the material, the latter being particularly desirable for shear sensitive particulates. In this embodiment, a sensor 29 may be comprised proximal to the reservoir 3 to measure the height of the solid particulate material in the reservoir 3 and may be arranged to impart a first signal each time said height is below a predetermined value, to activate the drive mechanism, and impart a second signal each time said height is above a predetermined value, to de-activate the drive mechanism. The drive mechanism may be arranged to impart, to said reservoir filling unit 21, an up/down displacement in a direction substantially parallel to axis Y, and the bottom surface of the reservoir filling unit may be at an angle to a horizontal plane (the horizontal plane being perpendicular to the axis Y) to ease material flow into the reservoir 3. Such arrangement ensures to maintain the reservoir 3 at the desired fill level whilst minimizing any shear forces onto the particulate material, the up and down motion having been found to be particularly beneficial in shear force reduction versus other motions.

Figure 7:
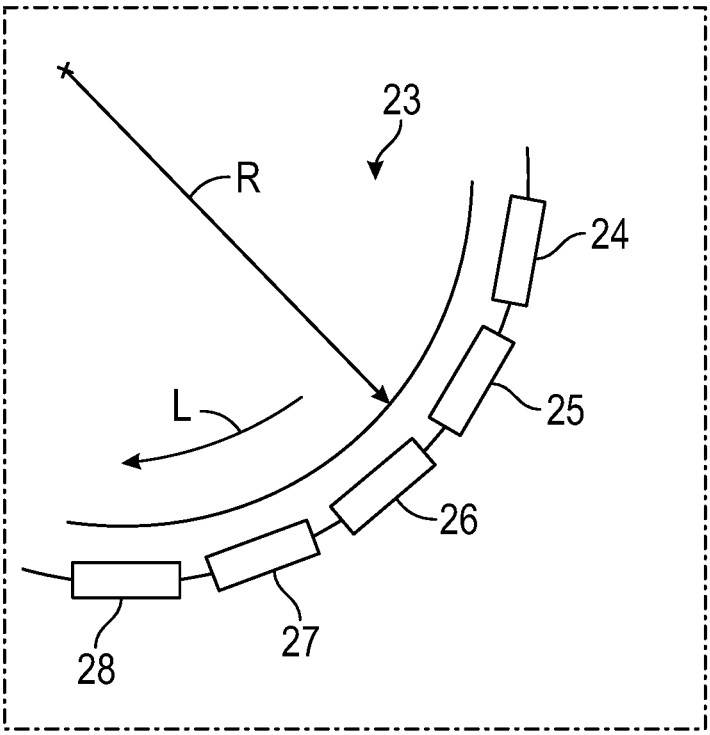
FIG. 7 is a diagrammatic representation illustrating the operation of a machine incorporating an apparatus according to an embodiment described herein.

In an embodiment, the apparatus herein may be incorporated into a carousel-type filling machine 23 (FIG. 7). The machine 23 may comprise a rotary turret or carousel which defines at least one circular line L for handling the receptacles and which is equipped with a plurality of operating stations for processing the receptacles. Preferably, the machine 23 has two adjacent and identical receptacle handling lines L, spaced apart along a vertical axis (the vertical axis being perpendicular to the plane of rotation along circular line L) running substantially parallel to each other (preferably one handling line for processing capsule caps and the other for processing capsule bodies).

The operating stations typically comprise: at least one station 24 for feeding the receptacles in a closed, empty configuration, that is to say, joined to each other but empty; an opening station 25 that may comprise an opening unit, where the receptacles are opened and separated into at least two components, preferably capsule caps and capsule bodies, to form two separate rows of opened receptacles; a station 26 for feeding and dosing the particulate material to be filled into the receptacles, preferably capsule bodies, said station comprising an apparatus as described herein; optionally a station 27 for feeding and dosing liquid material to be filled into the receptacles, said station comprising a liquid filling apparatus; optionally a station (not shown) for inserting a capsule within the receptacles e.g. to form a capsule in capsule dosage form; a station 28 for closing the receptacles (that may or may not be further incorporated within the apparatus described herein depending on the nature of the desired process), preferably by telescopically engaging the capsule cap over the capsule body; and, lastly, an outfeed station (not shown) for unloading the receptacles.

The receptacles herein may be made of, or consist of, an ingestible material comprising materials selected from the group consisting of gelatin, one or more polysaccharides, preferably pullulan; nonionic hydrogels, preferably cellulose such as hydroxypropyl methylcellulose (HPMC); and mixtures thereof. Most preferred materials being gelatin and/or hydroxypropyl methylcellulose (HPMC). Dosage form articles herein may be non-injection molded, and preferably made via a dip molding process. The latter ensures high production speeds and cost effectiveness. Other materials may also be used, as will be recognized by one skilled in the art, including cellulose ethers, such as starches (e.g. waxy maize starch, tapioca dextrin, and derivatives thereof), carrageenan, and polymers or copolymers of (meth)acrylic acids and derivatives thereof.

Typically, the receptacles are in the form of two-piece hard capsules comprising cap and body parts that may be substantially tubular in shape and each comprise a single opening.

The Solid Particulate Material

The solid particulate material 2 may consist of multi-particulates typically selected from the group consisting of pellets, lipid-multi-particulates, and mixtures thereof.

The multi-particulates may comprise one or more drugs, examples of suitable drugs being provided in the below passages.

The multi-particulates may further comprise optional materials selected from the group consisting of glidants, colorants and dyes, thickeners, structuring agents, surfactants, and the like. In any event, all such optional materials are preferably ingestible.

Pellets herein may be coated or uncoated. The nature of the coating will depend on the specific application intended. Suitable coatings in the art may be used, such as sugar coating. The pellets are preferably coloured, wherein all pellets are of the same colour or different colours.

Lipid-multi-particulates (LMPs) typically comprise one or more lipids as a lipid matrix, preferably a hydrophobic lipid matrix, typically comprising an active material (being the respective drug/medicament), a matrix material and optionally one or more excipient materials (such as talc, non-neutralized fatty acids, active neutralizing agents, pore formers, volatile co-species and mixtures). The lipid matrix may comprise one or more of: a mixture of monoglycerides, diglycerides, and triglycerides having a carbon number ranging from $C_6$ to $C_{40}$; esters of fatty acids having a carbon number ranging from $C_6$ to $C_{12}$ with ethylene glycol or propylene glycol; a mixture of triglyceridies having medium chain length; and/or a mixture of glycerides having a carbon number ranging from $C_{18}$ to $C_{24}$; and/or waxes (typically with melting point Tm below 70° C.), oils, long-chain alcohols, long-chain fatty acid esters, and mixtures thereof; and/or alkyl-containing glycerols, hydrogenated cottonseed oil, and mixtures thereof; and mixtures thereof.

It is however understood that other materials leading to similar difficult-to-handle particle physical properties may be suitably used in the apparatus and processes described herein. Some examples of suitable particulates that may be used herein are described in PCT/162014/000463, EP103068761, EP182738261, U.S. Pat. Nos. 7,625,507, 7,736,672, and EP1691787B1.

The LMPs described herein are ones that generally tend to smear and/or agglomerate with the application of shear. Such being due to the physical properties of such materials that are highly shear and temperature sensitive. These materials have been found to agglomerate into a butter-like substance, particularly during the dosing steps in standard filling machines in the art, such resulting in inconsistent dosing, clogging of the machine parts, and further negating some of the bioavailability benefits of the specific LMPs design. Surprisingly however, by utilizing the newly developed apparatus and process described herein such problem is overcome and reliable and continuous automatic filling of dosage forms with such LMPs is rendered possible.

Drugs (i.e. medicaments) suitable for use in the dosage forms described herein may take any form and be for any treatment of a human or animal subject. This includes not only pharmaceutical compounds but also dietary supplements such as vitamins, minerals and the like.

The drug may be in a state selected from solid or liquid, preferably solid, at room temperature and atmospheric pressure, and comprises one or more active compounds.

Suitable compounds for delivery according to the disclosure include, but are not limited to, particulate, powder, waxy, liquid, and/or pellet forms of the following:

a) pharmaceuticals (also called pharmaceutical actives) such as betamethasone, thioctic acid, sotalol, salbutamol, norfenefrine, silymahn, dihydroergotamine, buflomedil, etofibrate, indomethacin, oxazepam, acetyldigitoxins, piroxicam, halopehdol, isosorbide mononitrate, amithptyline, diclofenac, nifedipine, verapamil, pyritinol, nitrendipine, doxy-cycline, bromhexine, methylprednisolone, clonidine, fenofibrate, allopurinol, pirenzepine, levothyroxine, tamoxifen, metildigoxin, o-(B-hydroxyethyl)-rutoside, propicillin, aciclovir-mononitrate, paracetamolol, naftidrofuryl, pentoxifylline, propafenone, acebutolol, 1-thyroxin, tramadol, bromocriptine, loperamide, ketofinen, fenoterol, cadobesilate, propranolol, minocycline, nicergoline, ambroxol, metoprolol, B-sitosterin, enalaprilhydrogenmaleate, bezafibrate, isosorbide dinitrate, gallopamil, xantinolnicotinate, digitoxin, flunitrazepam, bencyclane, depanthenol, pindolol, lorazepam, diltiazem, piracetam, phenoxymethylpenicillin, furosemide, bromazepam, flunarizine, erythromycin, metoclo-pramide, acemetacin, ranitidine, biperiden, metamizol, doxepin, dipotassiumchloraze-pat, tetrazepam, estramustinephosphate, terbutaline, captopril, maprotiline, prazosin, atenolol, glibenclamid, cefaclor, etilefrin, cimetidine, theophylline, hydromorphone, ibu-profen, primidone, clobazam, oxaceprol, medroxyprogesterone, flecainide, Mg-pyhdoxal-5-phosphateglutaminate, hymechromone, etofyllineclofibrate, vincamine, cin-narizine, diazepam, ketoprofen, flupentixol, molsidomine, glibornuhde, dimethindene, melperone, soquinolol, dihydrocodeine, clomethiazole, clemastine, glisoxepid, kallidino-genase, oxyfedhne, baclofen, carboxymethylcystsin, thioredoxin, betahistine, 1-tryptophan, myrtol, bromelain, prenylamine, salazosulfapyridine, astemizole, sulpiride, benzerazid, dibenzepin, acetylsalicylic acid, miconazole, nystatin, ketoconazole, sodium picosulfate, colestyramate, gemfibrozil, rifampin, fluocortolone, mexiletine, amoxicillin, terfenadine, mucopolysaccharidpolysulfuric acid, triazolam, mianserin, tiaprofensaure, ameziniummethylsulfate, mefloquine, probucol, quinidine, carbamazepine, Mg-1-aspartate, penbutolol, piretanide, amitriptyline, caproteron, sodium valproinate, me-beverine, bisacodyl, 5-amino-salicyclic acid, dihydralazine, magaldrate, phenprocou-mon, amantadine, naproxen, carteolol, famotidine, methyldopa, auranofine, estriol, nadolol, levomepromazine, doxorubicin, medofenoxat, azathioprine, flutamide, norfloxacin, fendiline, prajmaliumbitartrate, aescin acromycin, anipamil, benzocaine, [beta]-carotene, cloramphenicol, chlorodiazepoxid, chlormadinoneacetate, chlorothiazide, cin-narizine, clonazepam, codeine, dexamethasone, dicumarol, digoxin, drotaverine, grami-cidine, griseofulvin, hexobarbital hydrochlorothiazide, hydrocortisone, hydroflumethiazide, ketoprofen, lonetil, medazepam, mefruside, methandrostenolone, sulfaperine, nalidixic acid, nitrazepam, nitrofurantoin, estradiol, papaverine, phenacetin, phenobarbi-tal, phenylbutazone, phenytoin, prednisone, reserpine, spironolactine, streptomycin, sul-famethizole, sulfamethazine, sulfamethoxoazole, sulfamethoxydiazinon, sulfathiazole, sulfisoxazole, testosterone, tolazamide, tolbutamide, trimethoprim, tyrothricin, antacids, reflux suppressants, antiflatulents, antidopaminergics, proton pump inhibitors, H2-receptor antagonists, cytoprotectants, prostaglandin analogues, laxatives, antispasmodics, antidiarrhoeals, bile acid sequestrants, opioids, beta-receptor blockers, calcium channel blockers, diuretics, cardiac glycosides, antiarrhythmics, nitrates, antianginals, vasoconstrictors, vasodilators, ACE inhibitors, angiotensin receptor blockers, alpha blockers, anticoagulants, heparin, antiplatelet drugs, fibrinolytic, anti-hemophilic factor, haemostatic drugs, hypolipidaemic agents, statins, hypnotics, anaesthetics, antipsychotics, antidepressants (including tricyclic antidepressants, monoamine oxidase inhibitors, lithium salts, selective serotonin reuptake inhibitors), antiemetics, anticonvulsants, an-tiepileptics, anxiolytics, barbiturates, movement disorder drugs, stimulants (including amphetamines), benzodiazepine, cyclopyrrolone, dopamine antagonists, antihistamines, cholinergics, anticholinergics, emetics, cannabinoids, 5-HT antagonists, analgesics, muscle relaxants, antibiotics, sulfa drugs, aminoglycosides, fluoroquinolones, bronchodilators, NSAIDs, anti-allergy drugs, antitussives, mucolytics, decongestants, corticosteroids, beta-receptor antagonists, anticholinergics, steroids, androgens, antian-drogens, gonadotropin, corticosteroids, growth hormones, insulin, antidiabetic drugs (including sulfonylurea, biguanide/metformin, and thiazolidinedione), thyroid hormones, antithyroid drugs, calcitonin, diphosponate, vasopressin analogs, contraceptives, follicle stimulating hormone, luteinising hormone, gonadotropin release inhibitor, progestogen, dopamine agonists, oestrogen, prostaglandin, gonadorelin, clomiphene, tamoxifen, di-ethylstilbestrol, antimalarials, anthelmintics, amoebicides, antivirals, antiprotozoals, vaccines, immunoglobulin, immunosuppressants, interferon, monoclonal antibodies, and mixtures thereof;

b) vitamins, e.g., fat-soluble vitamins such as vitamins A, D, E, and K, and water soluble vitamins such as vitamin C, biotin, folate, niacin, pantothenic acid, riboflavin, thiamin, vitamin B6, vitamin B12, and mixtures thereof;

c) minerals, such as calcium, chromium, copper, fluoride, iodine, iron, magnesium, manganese, molybdenum, phosphorus, potassium, selenium, sodium (including sodium chloride), zinc, and mixtures thereof;

d) dietary supplements such as herbs or other botanicals, amino acids, and substances such as enzymes, organ tissues, glandulars, and metabolites, as well as concentrates, metabolites, constituents, extracts of dietary ingredients, and mixtures thereof;

e) homoeopathic ingredients such as those listed in the Homeopathic Pharmacopoeia of the United States Revision Service (HPRS), and mixtures thereof. It must be recognized, of course, that the HPRS is periodically updated and that the present invention includes homeopathic ingredients that may be added to the HPRS; and mixtures in any combination of the foregoing.

Optional Fill Materials

The receptacles may be further filled with optional fill materials that may be in solid or liquid physical state, preferably liquid, during and/or post-filling (i.e. may be liquid at temperatures ranging from 15° C. to 70° C.).

In embodiments where the optional fill materials consist of liquids, the filling thereof into receptacles is carried out at a specific filling station proximal to the apparatus described herein.

The filling of such materials may be carried out prior to or after, preferably after, the filling of the multi-particulate material described herein.

Suitable optional fill materials may be selected from oils, such as vegetable oil like sunflower oil, soy bean oil, arachid oil, rape seed oil, olive oil; fish oil, krill oil or the like, or excipients common in the art.

The Process

The process of filling receptacles may comprise the, preferably sequential, steps of; providing an apparatus as described herein; immerging the dosing chamber(s) 6 into the solid particulate material 2 contained in the reservoir 3 with the dosing unit 4 in the dose collection position A; optionally adjusting an under-pressure source depending on the density, preferably the bulk density, of the material to be filled to regulate a suction force; applying a suction force (i.e. vacuum-like force) to retain a predetermined dose of said solid particulate material 2 into said dosing chamber(s) 6; emerging the dosing chamber(s) 6 out of said solid particulate material 2 contained in the reservoir 3; optionally removing any excess solid particulate material 2 resting on an outer surface 13, and/or proximal to an orifice 10, of said dosing chamber(s) 6, preferably by scraping said dosing chamber(s) 6 with one or more dosing chamber levelers 12; releasing said suction force, preferably simultaneously to a displacement of a pusher 9 within said dosing chamber(s) 6, to release said dose of solid particulate material into one or more receptacles with the dosing unit 4 in the dose release position B; and optionally applying a first blow of fluid triggered by a chamber un-contaminating blower 15 after said dose of solid particulate material is delivered into said one or more receptacles and typically substantially simultaneously to a movement of the dosing unit 4 from the dose release position B to the dose collection position A.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" (i.e. every value in a practical range close to 40 mm).

The invention claimed is:

1. An apparatus for dosing solid particulate material into one or more receptacles, the apparatus comprising:

a reservoir for containing an amount of solid particulate material, the reservoir having a bottom surface with an opening to receive a fluid to provide a fluidized bed of the solid particulate material;

a dosing unit comprising a dose collection position (A) for collecting a predetermined dose of the solid particulate material from the reservoir, and a dose release position (B) for releasing the solid particulate material into the one or more receptacles, the dosing unit comprising one or more dosing chambers that receive the solid particulate material in the dose collection position (A) and discharge the solid particulate material in the dose release position (B); and a receptacle handling unit for retaining the one or more receptacles, the receptacle handling unit being configured to at least periodically align at least one of the one or more receptacles with the dosing unit when in the dose release position (B);

wherein the fluid is a gas that is injected from a bottom surface of the reservoir to provide sufficient turbulence to keep the solid particulate material in a free-flowing and non-agglomerated state within the reservoir, and wherein the dosing chambers and/or the reservoir are moveable relative to each other along a perpendicular axis (Y), such that at least a portion of the one or more chambers is capable of being immerged into, and emerged out of, the solid particulate material in the reservoir at least when the dosing unit is in the dose collection position (A).

2. The apparatus according to claim 1 wherein the bottom surface comprises a fluid distributor arranged to uniformly distribute the fluid over substantially the entire bottom surface.

3. The apparatus according to claim 2 wherein the fluid distributor comprises a porous membrane having an average pore size no greater than 50 μm.

4. The apparatus according to claim 1 wherein the dose of solid particulate material is retained in the one or more dosing chambers by a force generated by an under-pressure source in fluid communication with the one or more dosing chambers the force being greater than or equal to a gravitational force acting onto the dose of the solid particulate material.

5. The apparatus according to claim 1 wherein the dosing unit further comprises a pusher for respective ones of the one or more dosing chambers.

6. The apparatus according to claim 5 wherein the pusher is arranged to slide within the one or more dosing chambers along a plane substantially parallel to the perpendicular axis (Y) and a depth of the pusher is directly proportional to the predetermined dose.

7. The apparatus according to claim 5 wherein the pusher has a tubular shape and a particle stopper at one end that is sized to prevent the passage of the solid particulate material through the pusher, and wherein the pusher is arranged to be in fluid communication with the one or more dosing chambers such that the gas may flow past the pusher and into the chamber.

8. The apparatus according to claim 1 wherein the one or more receptacles are oral dosage form articles.

9. The apparatus according claim 1 wherein the reservoir or the dosing unit comprises one or more dosing chamber levelers arranged to remove portions of the solid particulate material resting on an outer surface and/or proximal to an orifice of the dosing chamber once the dosing chambers have emerged out of the solid particulate material.

10. The apparatus according to claim 1 wherein the solid particulate material consists of multi-particulates selected from a group consisting of pellets, lipidmulti-particulates, and mixtures thereof.

11. The apparatus according to claim 1 wherein at least a portion of the dosing unit is arranged to rotate about an axis parallel to the perpendicular axis (Y), or translate along an axis perpendicular to the perpendicular axis (Y), from the dose collection position (A) to the dose release position.

12. The apparatus according to claim 1 wherein the dosing unit further comprises a chamber decontaminating blower in fluid communication with each dosing chamber and arranged to trigger a first blow of fluid through the dosing chamber to remove any residue of solid particulate material from the dosing chamber, wherein the decontaminating blower is arranged to trigger the first blow after a dose of solid particulate material has been delivered to the one or more receptacles.

13. The apparatus according to claim 12 wherein the dosing unit further comprises a dose release blower in fluid communication with each dosing chamber and arranged to trigger a second blow of fluid through the dosing chamber to release a predetermined dose of solid particulate material from the dosing chamber.

14. The apparatus according claim 1 wherein at least a portion of the dosing unit is coupled to a support; the support further comprising a dose converger arranged between the receptacle handling unit and the one or more dosing chambers along the perpendicular axis (Y); the converger, the receptacle handling unit and the one or more dosing chambers being substantially aligned with each other along the axis (Y) when the dosing unit is in the dose release position (B).

15. The apparatus according to claim 1 further comprising a hopper coupled to a reservoir filling unit for filling the reservoir with a constant amount of solid particulate material.

16. A process of filling one or more receptacles with a consistent dose of solid particulate material, the process comprising providing an apparatus according to claim 1;

immerging the one or more dosing chambers into solid particulate material contained in the reservoir with the dosing unit in the dose collection position (A);

applying a suction force to retain a predetermined dose of the solid particulate material into the one or more dosing chambers emerging the one or more dosing chambers out of the solid particulate material contained in the reservoir; and releasing the suction force to release the dose of solid particulate material into the one or more receptacles with the dosing unit in the dose release position (B).

* * * * *